US007743585B2

(12) United States Patent
Wheatley

(10) Patent No.: US 7,743,585 B2
(45) Date of Patent: Jun. 29, 2010

(54) STRUCTURE REINFORCEMENT SYSTEM

(76) Inventor: Donald E Wheatley, 1119 Wright St., Ann Arbor, MI (US) 48105

( * ) Notice: Subject to any disclaimer, the term of this patent is extended or adjusted under 35 U.S.C. 154(b) by 1401 days.

(21) Appl. No.: 10/832,019

(22) Filed: Apr. 26, 2004

(65) Prior Publication Data

US 2005/0241260 A1 Nov. 3, 2005

(51) Int. Cl.
*E04G 23/00* (2006.01)

(52) U.S. Cl. ..... 52/746.1; 52/514.5; 52/506.05; 52/347

(58) Field of Classification Search ..... 52/506.05, 52/506.01, 364, 367, 443, 514, 597, 745.05, 52/746.1, 741.3, 741.4, 745.09, 741.1, 293.2, 52/309.1, 309.2, 736.3, 514.5; 156/77, 91, 156/92, 98, 256, 257

See application file for complete search history.

(56) References Cited

U.S. PATENT DOCUMENTS

| | | | | |
|---|---|---|---|---|
| 3,239,403 | A | 3/1966 | Williams | |
| 4,786,341 | A * | 11/1988 | Kobatake et al. | 156/71 |
| 4,916,874 | A | 4/1990 | McCoy et al. | |
| 5,635,263 | A | 6/1997 | Saito | |
| 5,640,825 | A * | 6/1997 | Ehsani et al. | 52/746.1 |
| 5,649,398 | A | 7/1997 | Isley, Jr. et al. | |
| 5,845,450 | A | 12/1998 | Larsen | |
| 5,894,003 | A | 4/1999 | Lockwood | |
| 6,145,260 | A | 11/2000 | Morton | |
| 6,263,629 | B1 | 7/2001 | Brown, Jr. | |
| 6,418,684 | B1 | 7/2002 | Morton | |
| 6,692,595 | B2 | 2/2004 | Wheatley et al. | |
| 6,696,125 | B2 * | 2/2004 | Zanchetta et al. | 428/40.1 |
| 6,746,741 | B2 | 6/2004 | Wheatley | |
| 7,048,880 | B2 * | 5/2006 | Kia et al. | 264/101 |
| 2004/0194424 | A1 * | 10/2004 | Frost et al. | 52/741.1 |

FOREIGN PATENT DOCUMENTS

| | | |
|---|---|---|
| JP | 2000-265141 | 9/2000 |

OTHER PUBLICATIONS

ACI Structural Journal, Technical Paper, Title No. 91-S17, Mar.-Apr. 1994, "Strengthening of Initially Loaded Reinforced Concrete Beams Using FRP Plates", by Alfarabi Shari, G.J. Al-Sulaimani, I.A. Basunbuil, M.H. Baluch and B.N. Ghaleb.

ACI Structural Journal, Technical Paper, Title No. 91-S34, May-Jun. 1994, "Fiber Composites for New and Existing Structure" by Hamid Saadatmanesh.

* cited by examiner

*Primary Examiner*—Richard E Chilcot, Jr.
*Assistant Examiner*—William V Gilbert
(74) *Attorney, Agent, or Firm*—Harness, Dickey & Pierce, P.L.C.

(57) ABSTRACT

An assembly for reinforcing a structure is provided. The assembly generally includes a rigid sheet and a bracket. The rigid sheet is adapted to be adhered to the structure. The bracket includes a first leg and a second leg. The first leg is adapted to penetratingly engage the structure. The second leg adheres to the rigid sheet. The first and second legs extend substantially perpendicular to each other.

18 Claims, 7 Drawing Sheets

STRUCTURE REINFORCEMENT SYSTEM

FIELD OF THE INVENTION

The present invention relates to a device for reinforcing structures and a method of manufacturing and attaching the product to a structure and, in particular, to a device for reinforcing concrete walls including a rigidified sheet and at least one bracket for mechanically interconnecting the rigidified sheet to the concrete wall.

BACKGROUND OF THE INVENTION

Walls constructed of concrete blocks are well known in the field of construction and have been extensively used for walls both above and below ground. Walls constructed in this manner are generally capable of supporting residential and light commercial structures and are relatively inexpensive to manufacture. In order to construct a concrete wall, individual blocks are laid end-to-end and successive rows or courses are stacked thereon. Mortar between each adjacent block and row secures the wall together. These walls are such that they have excellent compressive strength to support structures placed upon them. However, these walls are inherently weak with respect to lateral loads and are particularly susceptible to cracking from water pressure. This inherent weakness is attributable to the structural characteristics of the walls themselves and the mortar joints at which they are connected. Specifically, the mortar joints are weak in tension and when subject to tensile forces, tend to separate relatively easily.

Water penetrating deeply into the soil adjacent a basement wall can cause substantial lateral movement of the soil and pressure against the wall. Over a period of time, block walls may be seen to develop diagonal cracks at their ends and vertical cracks near their centers. Such cracks can admit water from the surrounding soil and if left untreated, can progressively widen and eventually facilitate collapse of the entire wall with resultant damage to the structure supported on it. In addition to developing cracks, block walls typically either tilt or bow inwardly and such bowing or tilting steadily worsens under the weight of the overlying structure.

One of the traditional methods of repairing the cracks and relieving the external pressure is to drill holes and provide for channeling of the water away on the inside. Yet another method is to fill the cracks by injection of an epoxy resin. Although these methods help to control further water from entering the cracks, they do not prevent the walls from further cracking or bowing.

Yet another means of fixing cracks in concrete walls is to bond carbon fibers thereto, as disclosed in commonly owned U.S. Pat. No. 6,692,595. Carbon fibers are typically provided in a mesh-type structure such that an epoxy used to bond the fibers to the wall wholly encompass the fibers. Although carbon provides great tensile strength, it appears that in some installations it is strong enough to actually pull the concrete loose from the wall.

SUMMARY OF THE INVENTION

An assembly for reinforcing a structure is provided. The assembly generally includes a rigid sheet and a bracket. The rigid sheet is adapted to be adhered to the structure. The bracket includes a first leg and a second leg. The first leg is adapted to penetratingly engage the structure. The second leg adheres to the rigid sheet. The first and second legs extend substantially perpendicular to each other.

Another aspect of the present invention provides a method of reinforcing a structure. First, material is removed from the structure to form an elongated recess. A first article is adhered to the structure generally adjacent to the recess. A first leg of a second article is adhered in the recess such that a second leg of the second article adheres to the first article.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the scope of the invention, its application, or its uses.

Figure 1:
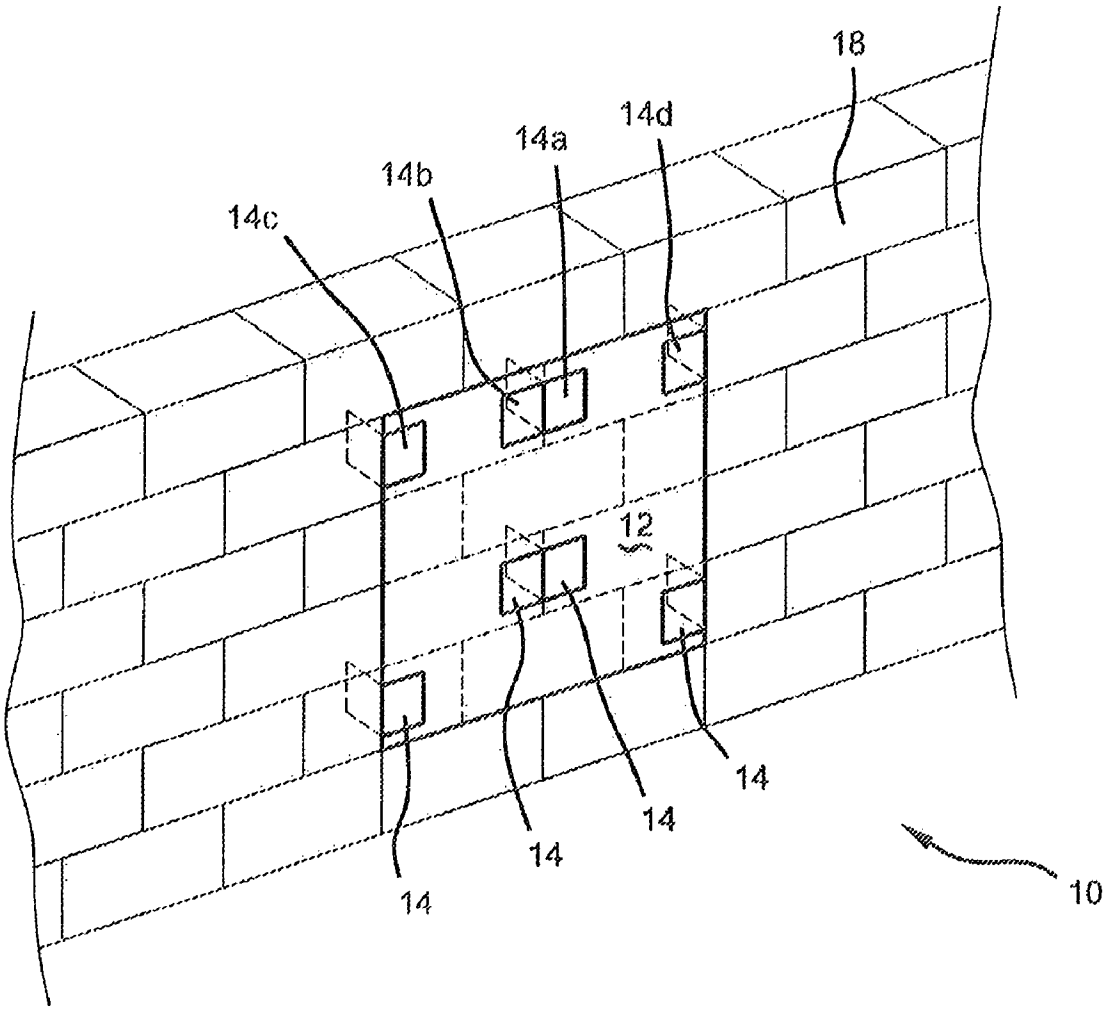
FIG. 1 is a perspective view of a first embodiment of a reinforcing assembly in accordance with the principles of the present invention.
Figure 2:
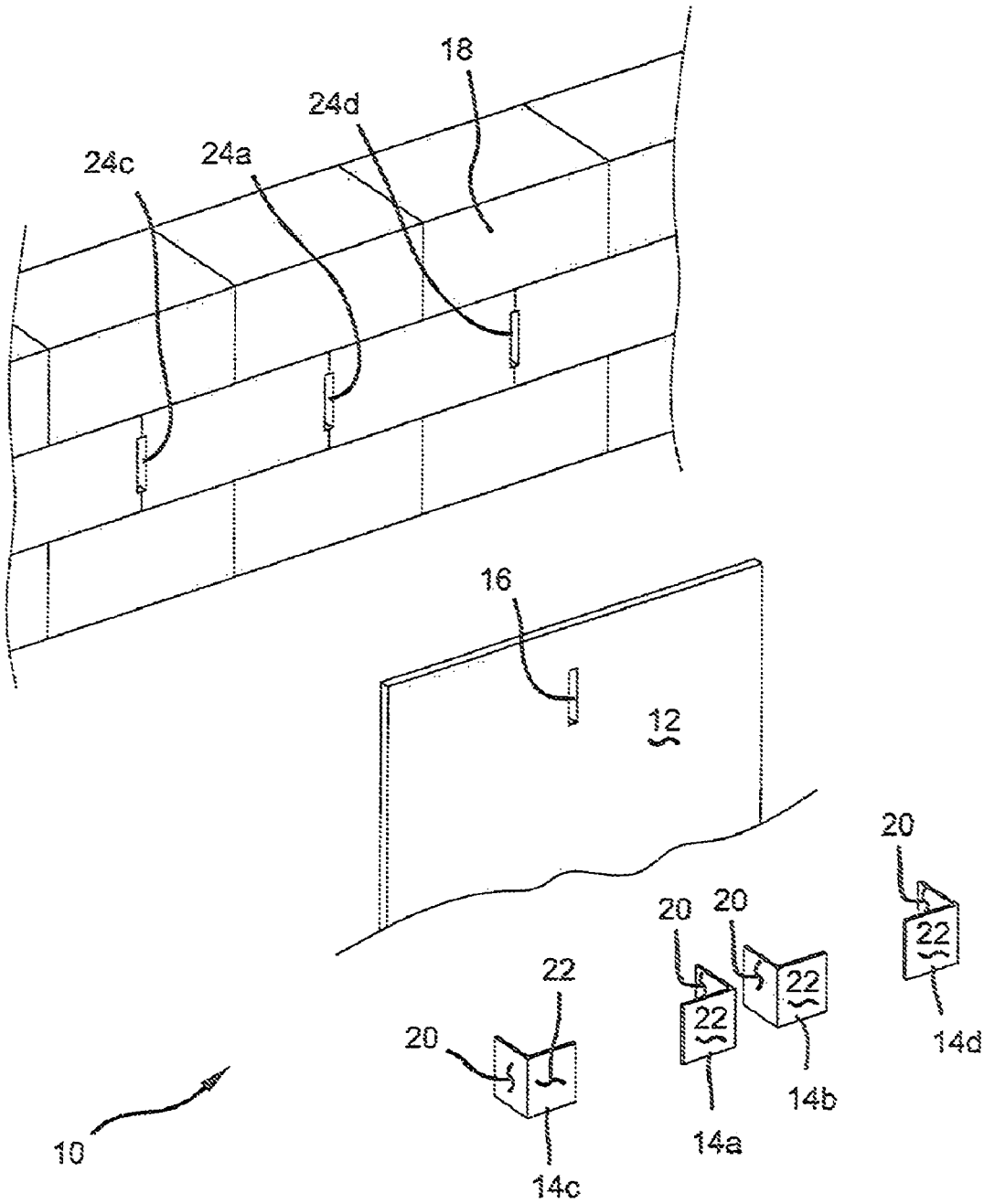
FIG. 2 is a partial exploded view of the reinforcing assembly of FIG. 1.

FIGS. 1 and 2 illustrate a first exemplary embodiment of a reinforcing assembly 10 in accordance with the present invention. The reinforcing assembly 10 generally includes a rigid sheet 12 and a plurality of brackets 14. The rigid sheet 12 is adapted to be adhered to a structure 18 and the brackets 14 are adapted to mechanically reinforce this adhesion. In one embodiment, the rigid sheet 12 and brackets 14 are metal plates. In another embodiment, the rigid sheet 12 and brackets 14 are rigidified mesh-structures, as will be described in more detail below. It should also be understood that the sheet 12 and brackets 14 can also be formed as non-rigid members although they are described in the preferred embodiments as being generally rigid.

The rigid sheet 12 is generally planar and includes at least one vertical slot 16 (shown in FIG. 2). In FIG. 1, the rigid sheet 12 is adhered to a structure 18 such as a masonry wall. In an exemplary embodiment, the rigid sheet 12 is adhered to the wall 18 with an epoxy resin. Each bracket 14 is generally L-shaped and includes a first leg 20 and a second leg 22. The first legs 20 are adapted to engage one of a plurality of recesses 24 (shown in FIG. 2) formed in the wall 18. The second legs 22 are adapted to engage the rigid sheet 12.

The brackets 14 can engage the rigid sheet 12 in a variety of alternative configurations. For example, brackets 14*a* and 14*b* illustrate a first configuration. The first legs 20 of brackets 14*a* and 14*b* are received through a common slot 16 formed in the rigid sheet 12. The first legs 20 then engage recess 24*a* formed in the wall 18. The recess 24*a* is preferably filled with an adhesive to securely anchor the first legs 20 in the recess 24*a*. Then, the second legs 22 engage the rigid sheet 12. In an exemplary embodiment, the second legs 22 are adhered to the rigid sheet 12 using an adhesive similar to that which adheres the rigid sheet 12 to the wall 18. It should be appreciated that in another configuration, only one bracket 14 is received through slot 16 to engage recess 24*a*.

Brackets 14*c* and 14*d* illustrate a second configuration. The first legs 20 of brackets 14*c* and 14*d* engage recesses 24*c* and 24*d* formed in the wall 18 without being received through a slot in the rigid sheet 12. The second legs 22 of brackets 14*c* and 14*d* then engage an edge region of the rigid sheet 12 and are adhered thereto. In each of the above-described configurations, the brackets 14 are adhesively anchored to the wall and mechanically reinforce the adhesive engagement between the rigid sheet 12 and the wall 18. Furthermore, it should be appreciated that each of the brackets 14 are substantially identical regardless of the configuration utilized.

Figure 3:
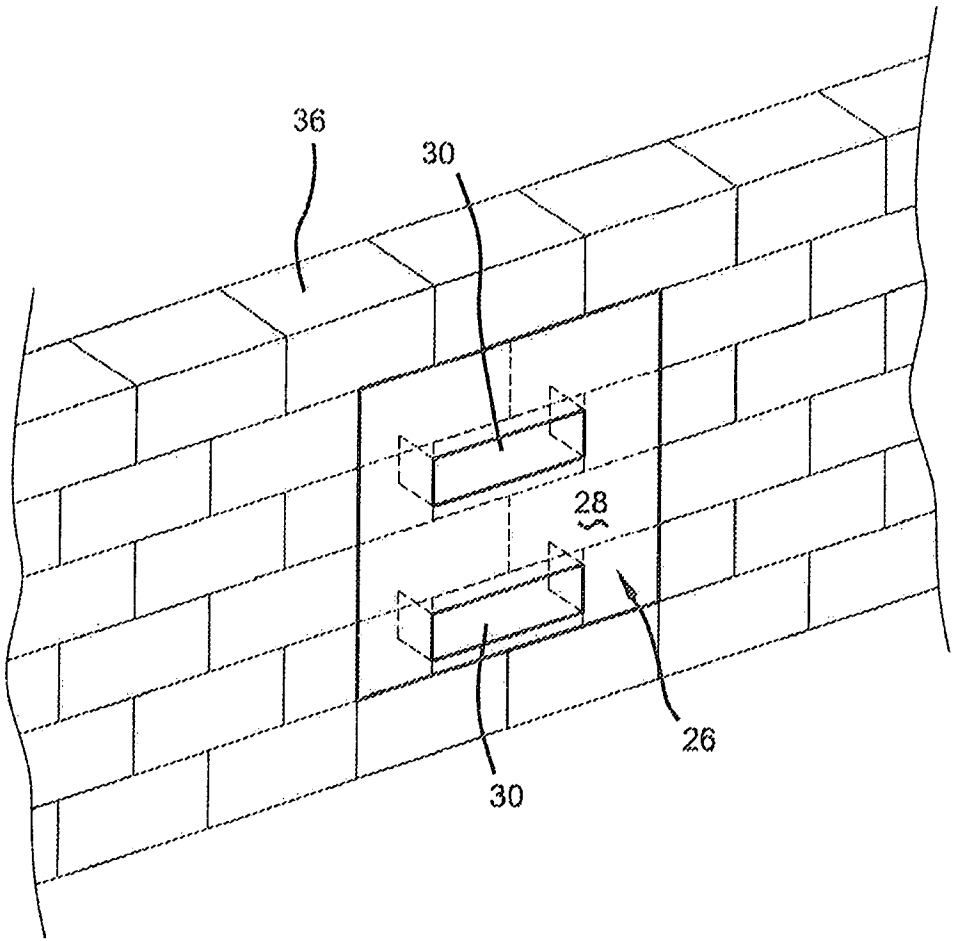
FIG. 3 is a perspective view of a second embodiment of a reinforcing assembly in accordance with the present invention.
Figure 4:
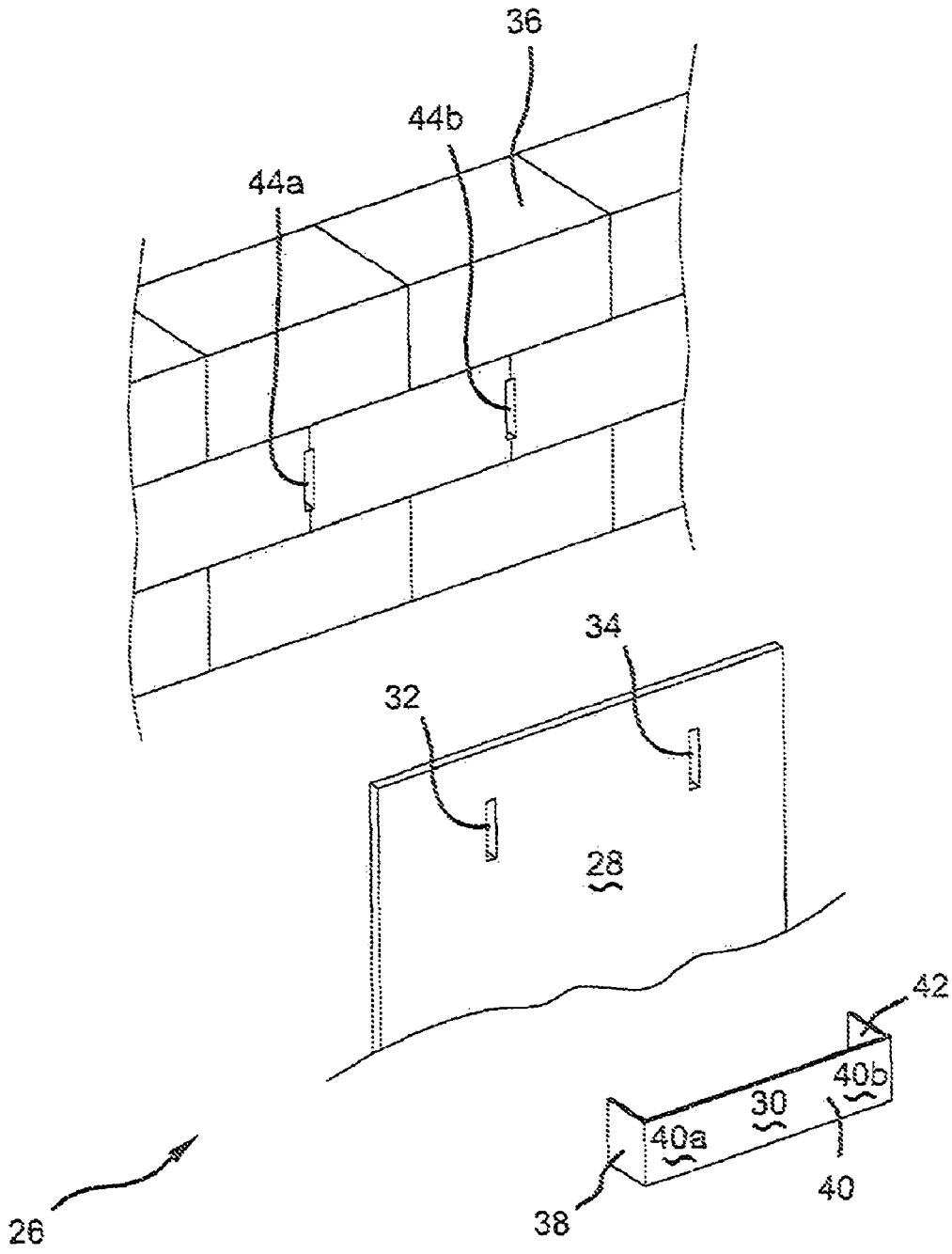
FIG. 4 is a partial exploded view of the reinforcing assembly of FIG. 3.

FIGS. 3 and 4 illustrate an alternative embodiment of a reinforcing assembly 26 in accordance with the present invention. The reinforcing assembly 26 generally includes a rigid sheet 28 and a plurality of brackets 30. The rigid sheet 28 is substantially similar to that of the first embodiment with the exception that it includes first and second substantially parallel vertical slots 32, 34. The rigid sheet 28 is adhered to a structure 36, such as a masonry wall. Similar to that described above, the rigid sheet 28 is adhered to the wall 36 with an epoxy resin or can be fastened by other known methods. Each bracket 30 includes a first leg 38, a bridge portion 40, and a second leg 42. The first leg 38 extends generally perpendicular from a first end 40*a* of the bridge portion 40. The first leg 38 is received through the first slot 32 formed in the rigid sheet 28 and adhesively engages a first recess 44*a* formed in the wall 36. The second leg 42 extends generally perpendicular from a second end 40*b* of the bridge portion 40. The second leg 42 is received through the second slot 34 in the rigid sheet 28 and adhesively engages a second recess 44*b* formed in the wall 36. The bridge portion 40 engages a region of the rigid sheet 28 located between the first and second slots 32, 34 and is adhered thereto. In this manner, the bracket 30 mechanically reinforces the adhesive engagement between the rigid sheet 28 and the wall 36.

Figure 5:
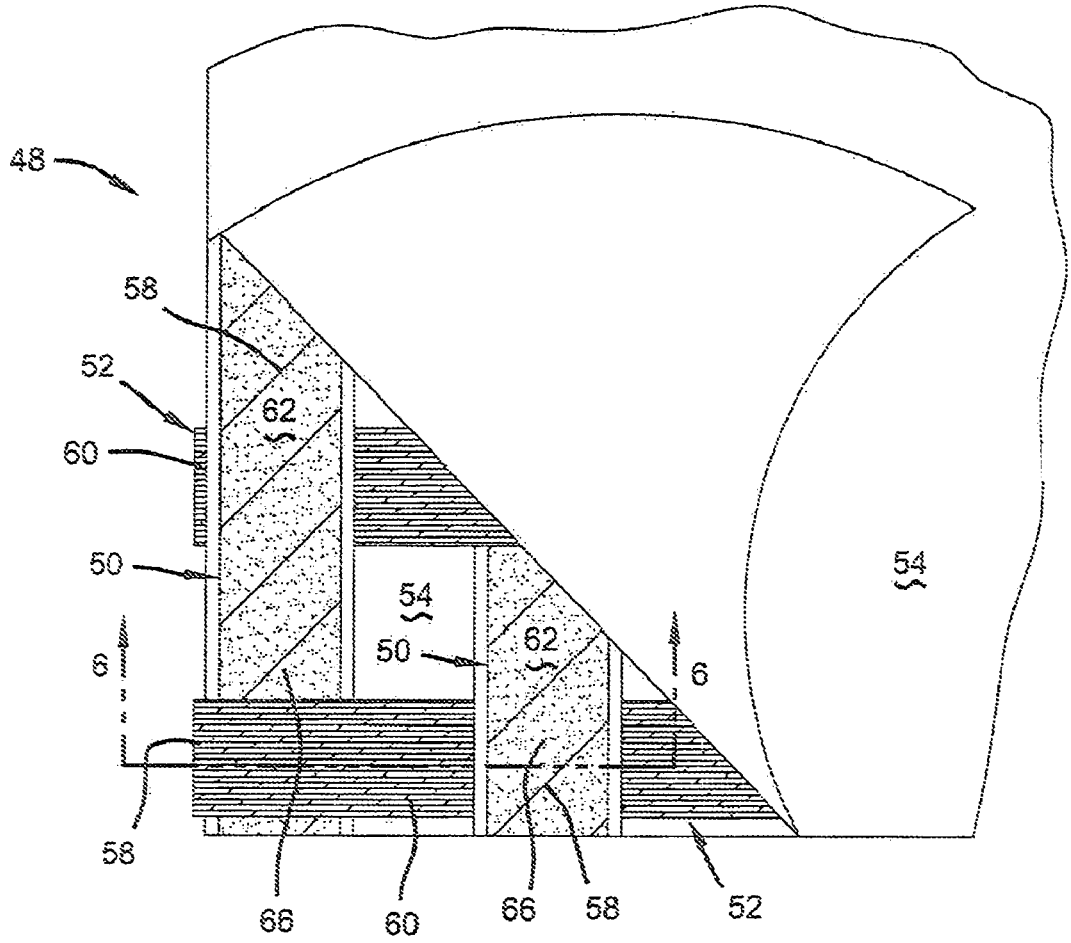
FIG. 5 is a partial detail view of a mesh structure in accordance with the present invention.
Figure 6:
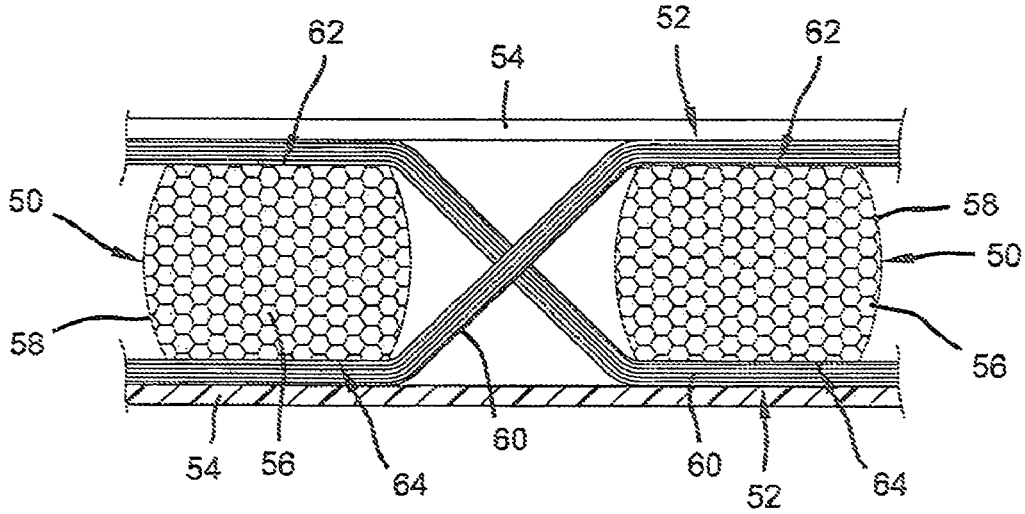
FIG. 6 is a cross-section through line VI-VI of FIG. 5.

Referring now to FIGS. 5 and 6, a mesh structure 48 as mentioned above as an alternative to a metal plate will now be described. The mesh structure 48 generally includes a plurality of longitudinally extending members 50 (preferably including carbon or similar material), a plurality of laterally extending members 52 (preferably including flexible fibers), and a removable film 54. The longitudinally extending members 50 are substantially parallel to one another and uniformly spaced apart a distance between 1/32" and 1". The laterally extending members 52 are also substantially parallel to each other and uniformly spaced apart a distance between 1/32" and 1". Furthermore, the laterally extending members 52 are interwoven between the longitudinally extending members 50, thereby defining the mesh structure 48. The mesh structure 48 further includes an adhesive coating (not shown). The adhesive coating increases the structural integrity of the mesh structure 48. In one embodiment, the adhesive coating is an epoxy resin. In another embodiment, the adhesive coating is a thermoset adhesive. The adhesive coating gives the mesh structure rigidity.

The removable film 54 includes an impermeable material such as nylon, plastic, or a textile and is preferably textured on at least one surface. The textured surface of the removable film 54 is adhered to the mesh structure 48 via the adhesive coating. The removable film 54 is adapted to be removed prior to adhering the rigid sheet 12, 28 and brackets 14, 30 to a wall 18, 36. In an exemplary embodiment, a piece of removable film 54 is attached to each side of the mesh structure 48. One purpose of the removable film 54 is to keep the surfaces of the mesh structure 48 clean and free from dust and debris, thereby increasing its bonding potential. The textured film 54 also provides a roughened surface to enhance the adhesive properties of the rigid sheet 12.

The longitudinally extending members 50 each include a plurality of fibers 56 bound together by a wrapping 58. In an exemplary embodiment, the fibers 56 are carbon fibers and the wrapping 58 includes a single strip of nylon coiled around the plurality of carbon fibers. In an alternative exemplary embodiment, the fibers 56 include a plurality of metal wires. In yet another alternative embodiment, the longitudinally extending members 50 are solid metal wires. The laterally extending members 52 each include a plurality of flexible fibers 60 such as nylon or Kevlar®.

The longitudinally extending members 50 are generally circular in cross-section having a first flattened surface 62 and a second flattened surface 64. The flattened surfaces 62 and 64 each include a plurality of indentations 66 formed in the adhesive coating. The plurality of indentations 66 are a product of the textured film 54. The plurality of indentations 66 increase the surface area of the mesh structure 48, thereby enhancing its engagement potential with an adhesive when adhered to a wall 18, 36.

A method of constructing the above-described mesh structure 48 in accordance with a reinforcing assembly 10, 26 of the present invention is now described. First, a plurality of rigid fibers 56 are bundled together and wrapped with wrapping 58. This is repeated until a multiplicity of longitudinally extending members 50 are prepared. Next, a plurality of flexible fibers 60 are gathered to form a laterally extending member 52. This is also repeated until a multiplicity of laterally extending members 52 are prepared. The multiplicity of laterally extending members 52 are then alternately interwoven above and below the longitudinally extending members 50. This creates the basic geometry of the mesh structure 48 shown in FIG. 5.

Next, the entire mesh structure 48 is wetted with a liquid adhesive to provide the adhesive coating described above. In an exemplary embodiment, the mesh structure 48 is submerged in an adhesive bath. In another embodiment, the mesh structure 48 is exposed to an adhesive mist. In yet another embodiment, a liquid adhesive is brushed or rolled onto the mesh structure 48.

Subsequent to applying the adhesive, but prior to it curing, a sheet of the removable film 54 is attached to each side of the mesh structure 48. The removable film 54 adheres to the adhesive. The next step depends on the intended purpose for the particular piece of mesh structure 48.

If the particular piece is intended to be used as a rigid sheet 12, 28, as discussed above, then the mesh structure 48 is compressed between two hard flat surfaces such as steel plates. This creates the first and second flat surfaces 62, 64 on the longitudinally extending members 50, as well as aiding the texture on the removable film 54 to transfer to the adhesive coating to create the plurality of indentations 66. Furthermore, compressing the mesh structure 48 provides for flattened laterally extending members 52, as shown in FIG. 6, thereby decreasing the overall thickness of the mesh structure 48. Next, the adhesive coating is allowed to cure, thereby rigidifying the mesh structure 48. If the adhesive coating is an epoxy resin, curing is achieved by simply allowing the resin to dry in a well ventilated area. If the adhesive coating is a thermoset adhesive, the mesh structure 48 must be heated to an activation temperature. This is typically done in an oven. The mesh structure 48 is placed in the oven and heated until the adhesive coating hardens. Thereafter, the mesh structure 48 may be cut or sawn to obtain a rigid sheet 12, 28 of any desired size and/or shape. Furthermore, the vertical slots 16, 32, 34 may also be cut, sawn, or otherwise formed into the rigid sheet 12, 28 at desired locations.

If the intended use for the particular piece of mesh structure 48 is a bracket 14, 30, then alternative steps are taken. Prior to allowing the adhesive coating to cure, the mesh structure 48 is formed into a bracket 14, 30. Often times, forming the bracket 14, 30 may not immediately follow the adhesive application described above and, therefore, necessary precautions must be taken to ensure that the adhesive does not prematurely cure. If the adhesive is an epoxy resin, premature curing can be prevented by sealing the wetted mesh structure 48 in a vacuum sealed wrapping, such as a plastic wrap. If the adhesive is a thermoset adhesive, premature curing can be prevented by freezing the wetted mesh structure 48. The frozen mesh structure 48 can then be thawed immediately prior to forming.

Forming the mesh structure 48 into a bracket 14, 30 requires a die assembly. The mesh structure 48 is compressed between two dies to form the desired bracket 14, 30 prior to the adhesive coating curing. In addition to forming the desired bracket 14, 30, this also creates the first and second flat surfaces 62, 64 on the longitudinally extending members 50, as well as aiding the texture of the removable film 54 to transfer to the adhesive coating to create the plurality of indentations 66. Furthermore, the compression tends to flatten the laterally extending members 52, thereby decreasing the overall thickness of the mesh structure 48.

Figure 7:
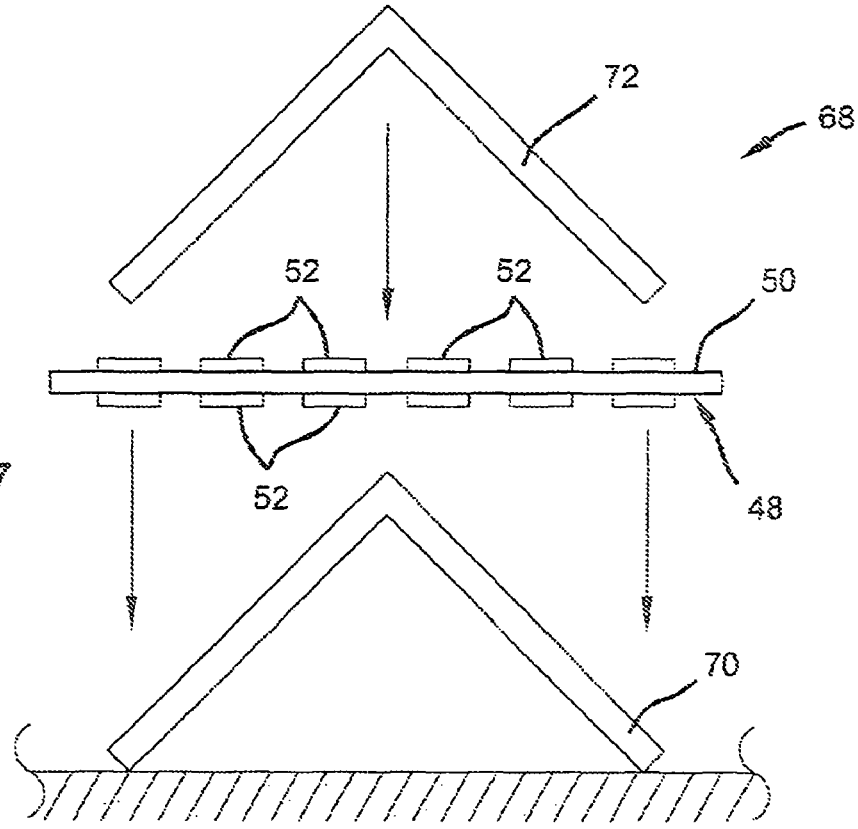
FIG. 7 is an end view of a first exemplary die assembly in accordance with the present invention.

FIG. 7 illustrates an exemplary die assembly 68 for forming an L-shaped bracket 14, as discussed above with reference to FIGS. 1 and 2. The mesh structure 48 is placed on a first die 70 and allowed to conform thereto. The first die 70 includes an elongated member having a generally inverted 90° L-shaped cross-section. It is important to note that the mesh structure 48 is placed on the first die 70 such that the longitudinally extending members 50 intersect the apex of the die 70. This ensures that the longitudinally extending members 50 are common to both the first 20 and second 22 legs of the bracket 14. This is important for the intended application because the longitudinally extending members 50 are designed to be strongest when loaded in tension. Therefore, the longitudinally extending members 50 of the first legs 20 of the brackets 14 will extend substantially perpendicular into the recesses 24 of the wall 18 to resist the wall 18 from bowing. In an exemplary embodiment, the longitudinally extending members 50 intersect the apex at approximately 90°. This is illustrated in FIG. 7. In an alternative embodiment, the longitudinally extending members 50 angularly intersect the apex at between 45° and 90°. After placing the mesh structure 48 on the first die 70, a second die 72 having substantially similar geometry to the first die 70 is placed over the mesh structure 48, thereby compressing it into the L-shaped bracket 14.

Figure 8:
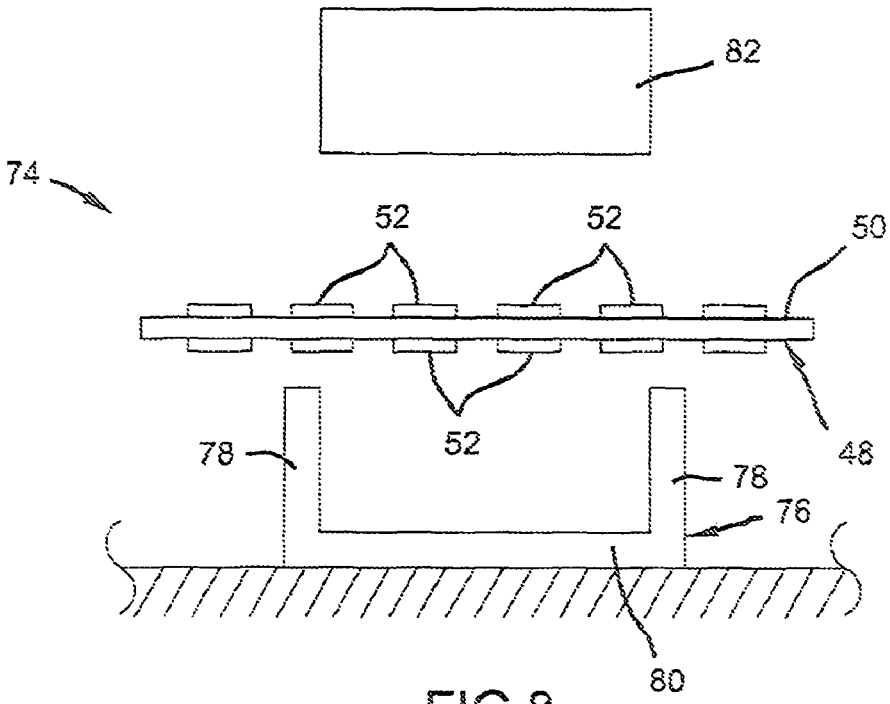
FIG. 8 is an end view of a second exemplary die assembly in accordance with the present invention.

FIG. 8 illustrates an exemplary die assembly 74 for forming a U-shaped bracket 30, as discussed above in accordance with FIGS. 3 and 4. A first die 76 generally includes an elongated member having a generally U-shaped cross-section defining a pair of sidewalls 78 and a base 80. The mesh structure 48 is placed therein and allowed to conform to its geometry. It should be appreciated that the mesh structure 48 must be placed in the U-shaped die 76 such as to form the longitudinally extending members 50 into a U-shape. As stated above, this is important because the longitudinally extending members 50 are strongest when loaded in tension. It is important to have as many longitudinally extending members 50 as possible common to the first leg 38, bridge portion 40, and second leg 42 of the brackets 30 to resist the wall 36 from bowing.

In an exemplary embodiment, the mesh structure 48 is placed in the U-shaped die 76 such that the longitudinally extending members 50 intersect the walls 78 at approximately 90°. This is illustrated in FIG. 8. In an alternative embodiment, the mesh structure 48 is placed in the U-shaped die 76 such that the longitudinally extending members 50 angularly intersect the walls 78 at between 45° and 90°. After placing the mesh structure 48 in the U-shaped die 76, a second die 82 is placed into the first die 76 to sandwich the mesh structure 48. The second die 82 includes an elongated member having a substantially rectangular cross-section. It should be appreciated that the rectangular die 82 has a slightly smaller horizontal dimension than the U-shaped die 76. In an exemplary embodiment, the horizontal dimension of the rectangular die 82 is approximately twice the thickness of the mesh structure 48 smaller than an inner horizontal dimension of the U-shaped die 76. This ensures that the rectangular die 82 will fit into the U-shaped die 76 to form a bracket 30 having first 38 and second legs 42 substantially perpendicular to the bridge portion 40. It should be appreciated that the above-described dies are only exemplary in nature and that alternative means of creating similar brackets are intended to be within the scope of the present invention. It should further be appreciated that while only L-shaped and U-shaped brackets have been disclosed herein, alternative geometries are intended to be within the scope of the present invention.

Finally, after the mesh structure 48 is appropriately compressed with the desired die assembly, the adhesive coating is allowed to cure and rigidify the bracket 14, 30. This is accomplished by either of the processes described above depending on the type of adhesive coating employed.

Figure 9:
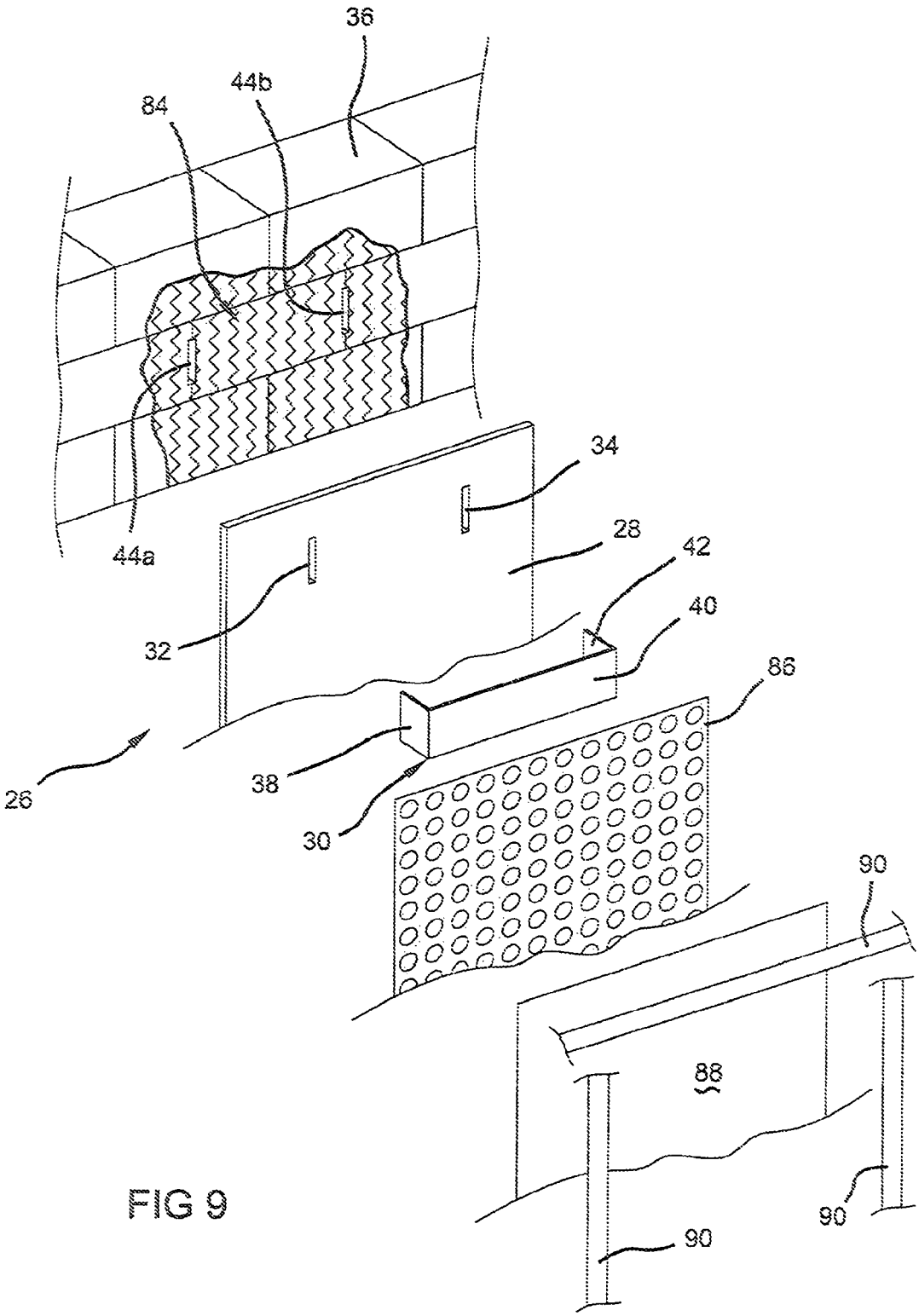
FIG. 9 is an exploded view illustrating various components utilized during an attachment process of a reinforcing assembly in accordance with the present invention.

With reference to FIG. 9, a process for attaching a reinforcing assembly 26 to a wall and the components necessary to do so are described. For the sake of brevity, the process is only described according to the second embodiment of the assembly 26. It should be appreciated, however, that a similar process can be employed according to the first embodiment of the assembly 10, as described above with reference to FIGS. 1 and 2. As stated above, the assembly 26 generally includes a U-shaped bracket 30 and a rigid sheet 28 having first and second vertical slots 32, 34.

Initially, material is removed from the wall 36 to form a first elongated recess 44*a* and a second elongated recess 44*b*. The recesses 24 are positioned on the wall such that they can be aligned with the slots 32, 34 in the rigid sheet 28. In an exemplary embodiment, the slots 32, 34 in the rigid sheet are spaced apart the same distance as a pair of mortar joints in the masonry wall. This will provide for less work in the material removing process because mortar is typically softer than block or brick although it should be appreciate that the recesses 44*a*, 44*b* can also be formed in the blocks or bricks. An adhesive 84 is then applied to the wall 36 inside and around the first and second recesses 44. In an exemplary embodiment, the adhesive 84 includes an epoxy resin. Next, the rigid sheet 28 is positioned adjacent to the wall 36 such that the slots 32, 34 align with the recesses 44*a*, 44*b*, respectively. In the embodiment where the rigid sheet 28 is a mesh structure, it is important to note that the rigid sheet 28 should be positioned such that the longitudinally extending members 50 are vertical. This will ensure that when the rigid sheet 28 is secured to the wall 36, the longitudinally extending members 50 will be in tension to counteract the wall 36 from bowing outward. The rigid sheet 28 is then attached to the wall 36, via the adhesive 84. In the embodiment wherein the rigid sheet 28 includes a mesh structure 48, the adhesive 84 will squeeze through the perforations located between the longitudinally 50 and laterally 52 extending members (as shown in FIGS. 5 and 6). This will effectively encapsulate the members 50, 52 in the adhesive 84.

Next, the bracket 30 is positioned for insertion through the slots 32, 34 and into the recesses 44. The first and second legs 38, 42 of the bracket 30 are then inserted through the slots 32, 34 in the rigid sheet 28 and into the recesses 44. The bridge portion 40 is forced against the rigid sheet 28 and adhered thereto. If the rigid sheet 28 is a metal plate, additional adhesive 84 may be required in the region where the bridge portion 40 engages the rigid sheet 28. If the rigid sheet 28 is a mesh structure 48, no additional adhesive needs to be applied because excess adhesive 84 has already squeezed through the perforations between the longitudinally 50 and laterally 52 extending members. This excess adhesive 84 should suffice to adhere the bridge portion 40 to the rigid sheet 28. It should be appreciated, however, that additional adhesive 84 may be applied if necessary. The above process is repeated for as many brackets 30 as the specific application requires. Once the rigid sheet 28 and the bracket 30 are positioned on the wall 36, an additional step can be taken to ensure that no air pockets exist in the adhesive 84 behind the rigid sheet 28.

An evacuation material 86, such as commercially available bubble wrap or plastic sheeting, is positioned in front of the rigid sheet 28. An impermeable material 88, such as plastic, is positioned in front of the evacuation material 86 and fastened by its perimeter to the wall with strips of tape 90. The dimensions of the impermeable material 88 are slightly greater than the dimensions of both the rigid sheet 28 and the evacuation material 86 such that the strips of tape 90 can completely seal it to the wall 36. With the impermeable material 88 mounted to the wall 36 over the rigid sheet 28 and the evacuation material 86, air may be evacuated with a vacuum (not shown). The vacuum is coupled to a vacuum line fitted between the impermeable material 88 and the wall 36. Employing the vacuum in combination with the evacuation material 86 provides for uniform application of force across the entirety of the rigid sheet 28. If the rigid sheet 28 includes a mesh structure 48, as described above, the vacuum further squeezes the adhesive 84 through the perforations between the longitudinally 50 and laterally 52 extending members further encapsulating the mesh structure 48 therein. Under this method, the normal curing time for common epoxies is between 3-4 hours. Once cured, the impermeable material 88 and evacuation material 86 is removed from the wall 36. The rigid sheet 28 remains attached to the wall 36 via the adhesive 84 and the bracket 30 to counteract the wall 36 from bowing. It should be understood that the vacuum pressure may be unnecessary since applying a plastic sheet to damp adhesive creates a naturally occurring vacuum affect that resists the removal of the plastic from the reinforced structure.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method of reinforcing a structure comprising:

removing material from the structure to form a first elongated recess;

adhering a first article comprising a fiber reinforcement layer to said structure generally adjacent to said first recess; and adhering a generally planar first leg of a rigidified second article in said first elongated recess, said second article comprising a bracket, and adhering a generally planar second leg of said rigidified second article to said first article, wherein said adhering of said first article is performed prior to said adhering of said first leg of said rigidified second article and said adhering of said second leg of said rigidified second article, and wherein said rigidified second article reinforces the adhesive engagement between said first article and the structure, wherein said rigidified second article is rigidified prior to adhering and said first and second legs of said rigidified second article are generally planar in the installed position and said second leg extends generally perpendicular to said first leg.

2. The method of claim 1 further comprising applying an adhesive to the structure generally adjacent to and in said first recess prior to adhering said first article to said structure.

3. The method of claim 1 further comprising aligning a slot in said first article with said first recess prior to adhering said first article to said structure.

4. The method of claim 3 further comprising inserting said first leg of said rigidified second article through said slot prior to adhering said first leg of said rigidified second article in said first recess.

5. The method of claim 1 further comprising removing a film from at least one side of said first article prior to adhering said first article to said structure.

6. The method of claim 1 further comprising adhering a first leg of a rigidified third article in said first recess such that a second leg of said rigidified third article adheres to said first article, wherein said rigidified third article is separate from and substantially similar to said rigidified second article.

7. The method of claim 1 further comprising:

removing material from the structure to form a second elongated recess; and adhering a third leg of said rigidified second article in said second recess substantially contemporaneously with adhering said first leg in said first recess.

8. A method of reinforcing a structure, comprising:

substantially saturating a first article and a second article comprising a fiber reinforcement sheet with an adhesive;

forming said second article into a bracket having a generally planar first leg and a generally planar second leg that are substantially perpendicular to each other;

allowing said adhesive to cure, thereby hardening said first and second articles into a rigidified fiber reinforcement sheet and a rigidified bracket, respectively;

removing material from the structure to form an elongated recess;

adhering said rigidified fiber reinforcement sheet to said structure generally adjacent to said recess; and adhering said first leg of said rigidified bracket in said recess such that said second leg adheres to said first article, wherein said adhering of said first article is performed prior to said adhering of said first leg and said adhering of said second leg, and wherein said rigidified bracket reinforces the adhesive engagement between said rigidified fiber reinforcement sheet and the structure.

9. The method of claim 8 wherein forming said second article into a bracket includes shaping said second article into an L-shape.

10. The method of claim 8 wherein forming said second article into a bracket includes shaping said second article into a U-shape.

11. The method of claim 8 wherein hardening said first and second articles includes heating said first and second articles in an oven.

12. The method of claim 8 wherein saturating said first and second articles includes submerging said first and second articles into an adhesive bath.

13. The method of claim 8 further comprising applying a removable film to at least one side of said first article prior to hardening said first article, wherein said removable film is textured to provide a plurality of indentations on at least a portion of said first article.

14. The method of claim 13 further comprising removing said removable film from said rigidified fiber reinforcement sheet prior to adhering said first article to said structure.

15. The method of claim 8 further comprising applying a removable film to at least one side of said second article prior to hardening said second article, wherein said removable film is textured to provide a plurality of indentations on at least a portion of said second article.

16. The method of claim 15 further comprising removing said removable film from said rigidified bracket prior to adhering said first leg of said rigidified bracket in said recess.

17. The method of claim 8 wherein said first and second articles include a plurality of longitudinally extending carbon fibers interwoven with a plurality of laterally extending flexible fibers.

18. The method of claim 8 wherein said first and second articles include a plurality of longitudinally extending metal wires interwoven with a plurality of laterally extending flexible fibers.

* * * * *